US009540909B2

(12) United States Patent
Wolf et al.

(10) Patent No.: US 9,540,909 B2
(45) Date of Patent: Jan. 10, 2017

(54) DIVERTER LATCH ASSEMBLY SYSTEM

(71) Applicants: John Chysostom Wolf, Houston, TX (US); Luis A. Gonzalez, Humble, TX (US)

(72) Inventors: John Chysostom Wolf, Houston, TX (US); Luis A. Gonzalez, Humble, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 1079 days.

(21) Appl. No.: 13/630,581

(22) Filed: Sep. 28, 2012

(65) Prior Publication Data

US 2014/0090894 A1 Apr. 3, 2014

(51) Int. Cl.
*E21B 7/06* (2006.01)
*E21B 41/00* (2006.01)

(52) U.S. Cl.
CPC ..... *E21B 41/0042* (2013.01); *E21B 7/061* (2013.01); *E21B 41/0035* (2013.01)

(58) Field of Classification Search
CPC .... E21B 7/061; E21B 23/002; E21B 41/0035; E21B 41/0042; E21B 17/021
See application file for complete search history.

(56) References Cited

U.S. PATENT DOCUMENTS

| | | | | |
|---|---|---|---|---|
| 5,353,876 | A | 10/1994 | Curington et al. | |
| 5,454,430 | A | 10/1995 | Kennedy et al. | |
| 5,655,602 | A * | 8/1997 | Collins | E21B 7/043 166/313 |
| 6,732,801 | B2 | 5/2004 | Ohmer et al. | |
| 2002/0074121 | A1 * | 6/2002 | Schick | E21B 7/061 166/313 |
| 2010/0170677 | A1 | 7/2010 | Ingraham | |
| 2012/0261130 | A1 * | 10/2012 | Linn | E21B 23/002 166/313 |

FOREIGN PATENT DOCUMENTS

WO 2012125619 A2 9/2012

* cited by examiner

*Primary Examiner* — David Andrews
*Assistant Examiner* — Tara Schimpf
(74) *Attorney, Agent, or Firm* — Michael Stonebrook

(57) ABSTRACT

A system and methodology facilitates use of a diverter latch assembly in cooperation with a lateral wellbore. The diverter latch assembly comprises an upper latch assembly coupled with a lower latch assembly via a swivel. The upper latch assembly also comprises a releasable latch positioned to engage a tieback receptacle located in the well. The swivel and the releasable latch are designed to enable rotation of the releasable latch relative to a tubing of the lower latch assembly during release of the diverter latch assembly from the tieback receptacle. The rotational release system helps provide controlled release and withdrawal of the diverter latch assembly while reducing risk of damage to the diverter latch assembly or other downhole components.

22 Claims, 5 Drawing Sheets

DIVERTER LATCH ASSEMBLY SYSTEM

BACKGROUND

In a variety of multilateral well systems, diverters are used to facilitate reentry into either the main or lateral wellbores. During construction of the junction between the main wellbore and a lateral wellbore, a diverter may be installed as a torque tube for running the junction equipment. Subsequently, the diverter is pulled and a drilling diverter is installed to facilitate a drilling operation. Drilling diverters generally are designed to snap into engagement with downhole equipment, e.g. completion equipment, positioned in the well. Upon completion of the drilling operation, the drilling diverter is disengaged by applying a tensile snap out force. To avoid unwanted disengagement, however, drilling diverters are designed such that a substantial snap out force is used to disengage the drilling diverter.

SUMMARY

In general, the present disclosure provides a system and method for employing a diverter latch assembly in cooperation with a lateral wellbore. The diverter latch assembly comprises an upper latch assembly coupled with a lower latch assembly via a swivel. The upper latch assembly also comprises a releasable latch positioned to engage a tieback receptacle located in the well. The swivel and the releasable latch are designed to enable rotation of the releasable latch relative to a tubing of the lower latch assembly during release of the diverter latch assembly from the tieback receptacle. The rotational release system facilitates controlled release and withdrawal of the diverter latch assembly with a reduced risk of damage to the diverter latch assembly or other downhole components.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
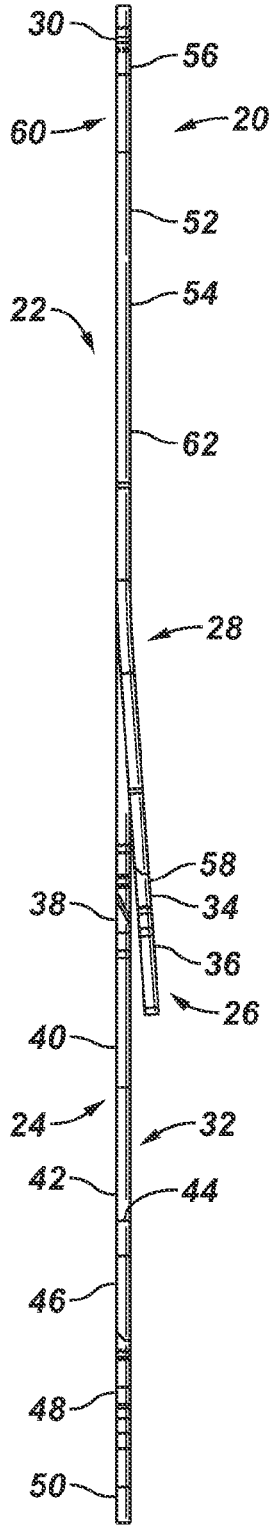
FIG. 1 is an illustration of a well system comprising a lateral wellbore system and an embodiment of a drilling diverter latch assembly engaged at the lateral wellbore system, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally involves a system and methodology that relate to facilitating operations in a lateral wellbore. The system and methodology utilize a diverter latch assembly which may be sealed across a lateral junction and comprises an upper latch assembly coupled with a lower latch assembly via a swivel. The upper latch assembly also comprises a releasable latch positioned to engage a tieback receptacle located in the well. The swivel and the releasable latch are designed to enable rotation of the releasable latch relative to tubing (e.g. relative to a latch assembly casing) of the lower latch assembly during release of the diverter latch assembly from the tieback receptacle. The rotational release system facilitates controlled release and withdrawal of the diverter latch assembly while reducing risk of damage to the diverter latch assembly or other downhole components. In many applications, the diverter latch assembly may be used to facilitate a drilling operation while providing a sealed connection across a junction with a lateral wellbore. However, the diverter latch assembly also may be used to facilitate a variety of other types of operations, e.g injection operations or well preparation operations.

By way of example, during the construction of a TAML level 3-5 multilateral junction, the length of a lateral wellbore may be increased by drilling further into the formation. This drilling operation can be accomplished by running a drilling string through a lateral wellbore section and drilling into an open hole to increase the length of the lateral leg of the well. The present system and methodology provides an assembly which enables formation of a junction between the main wellbore and the lateral wellbore which has hydraulic integrity while also facilitating easy removal of the assembly upon completion of the drilling operation and/or other operation.

In preparing for the drilling operation, various types of equipment may be deployed downhole. For example, completion equipment may be deployed downhole and may comprise a plurality of tieback receptacles designed to receive a diverter system which enables the drill string to be diverted into the desired lateral wellbore. As described herein, the diverter system comprises a drilling diverter latch assembly that may be deployed with a standard running tool, e.g. a standard liner hanger running tool with a standard profile. The drilling diverter latch assembly also may be constructed to provide a large inner diameter to facilitate running of drill bits with large outer diameters. The drilling diverter latch assembly also may comprise anti pre-release features which prevent the drilling diverter latch assembly from being released accidentally while tripping the drill string through the diverter system. Additionally, the drilling diverter latch assembly may comprise a rotational release/latch system having a rotational release bearing which allows controlled release of the assembly from a tieback receptacle via rotation of an upper portion of the assembly. The assembly also may comprise built-in seals and debris barriers to isolate the junction while protecting the assembly from debris which could otherwise interfere with the releasable latch system.

Referring generally to FIG. 1, an embodiment of a system, e.g. a well system, for enabling a drilling operation or other type of operation in a lateral wellbore is illustrated. By way of example, the well system may comprise many types of components and may be employed in many types of applications and environments, including cased wells and open-hole wells. The well system also may be utilized in horizontal wells and other deviated wells. The system may employ various constructions of a diverter latch assembly in combination with several types of well completions or other well equipment located downhole.

In the example of FIG. 1, a system 20 is illustrated in the form of a well system deployed in a well 22 having a main wellbore 24 and a lateral wellbore 26. In lateral wellbore drilling applications, system 20 is designed to facilitate drilling of the lateral wellbore 26 while providing a hydraulic seal across a junction 28 between the main wellbore 24 and the lateral wellbore 26. In general, system 20 comprises a diverter latch assembly 30, e.g. a drilling diverter latch assembly, which is used in cooperation with downhole well equipment 32, e.g. downhole completions, previously deployed into the well 22. Depending on the parameters of a given application and/or environment, the specific components and arrangements of components in both the diverter latch assembly 30 and the downhole well equipment 32 may vary. Accordingly, the components described in the embodiment illustrated in FIG. 1 are provided as examples to facilitate explanation and many other components and arrangements may be utilized.

In the example illustrated, the downhole well equipment 32 may comprise a lateral bore assembly 34 having a lower tieback receptacle 36 deployed in the lateral wellbore 26. Additionally, well equipment 32 may comprise various components located in main wellbore 24, including a main bore assembly 38 used in cooperation with a polished bore receptacle 40. In the example illustrated, a main bore liner 42 is located below the polished bore receptacle 40 and above both a production latch assembly 44 and a lower main wellbore tieback receptacle 46. Other components, such as a packer 48 and a liner hanger 50 also may be positioned below junction 28. Above junction 28, the well equipment 32 may comprise a variety of components, such as a lateral packer 52, a lateral packer alignment sub 54, and an upper tieback receptacle 56.

Similarly, the diverter latch assembly 30 also may comprise a variety of components and arrangements of components. In the specific example illustrated, diverter latch assembly 30 is constructed as a drilling diverter latch assembly and comprises a lower latch assembly portion 58 of the overall drilling diverter latch assembly 30 coupled with an upper latch assembly portion 60 of the overall drilling diverter latch assembly 30. In this example, the upper portion 60 is selectively engaged with and latched into the upper tieback receptacle 56. In at least some applications, the lower portion 58 may comprise a relatively long section of tubing 62, e.g. diverter casing, that bends into lateral wellbore 26 through junction 28 below upper portion 60.

Figure 2:
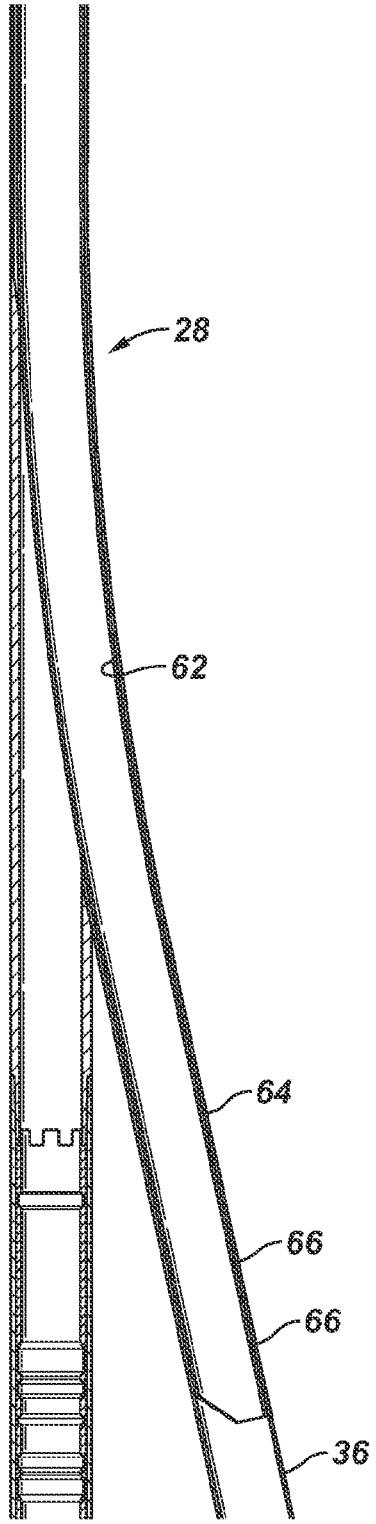
FIG. 2 is an illustration of an enlarged portion of the system illustrated in FIG. 1, according to an embodiment of the disclosure.
Figure 3:
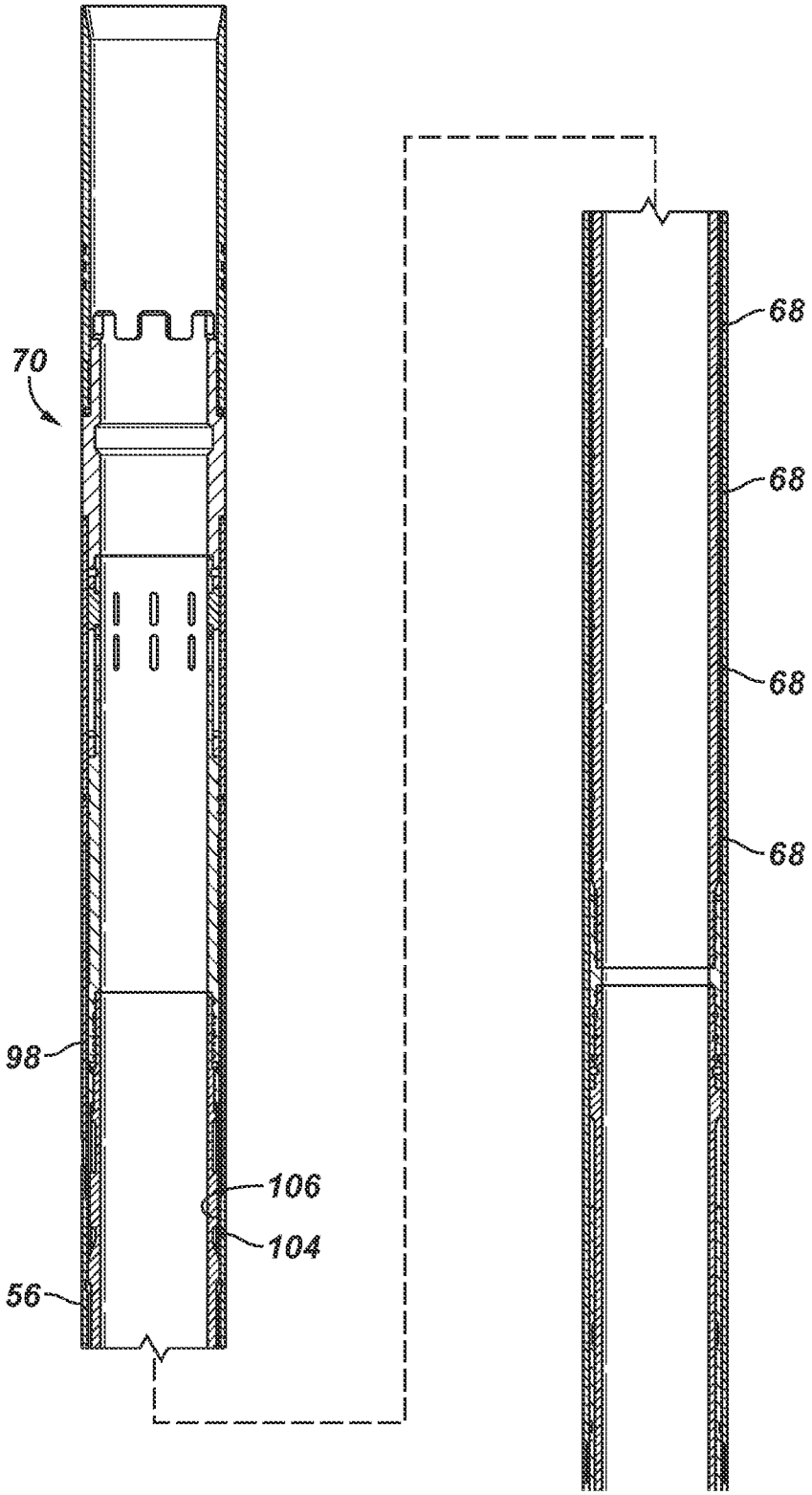
FIG. 3 is an illustration of another enlarged portion of the system illustrated in FIG. 1, according to an embodiment of the disclosure.

In FIG. 2, an enlarged view of the lower portion 58 of drilling diverter latch assembly 30 is illustrated. As illustrated, the lower portion 58 may be constructed with a stinger 64 which stabs into the lower tieback receptacle 36. The stinger 64 may be combined with a plurality of seals 66 designed to seal against an interior of the tieback receptacle 36 to hydraulically seal/isolate junction 28 from the lateral wellbore 26 during, for example, a drilling operation. In FIG. 3, an enlarged view of the upper portion 60 of the drilling diverter latch assembly 30 is illustrated. In this example, the upper portion 60 slides into the upper tieback receptacle 56 and forms a seal along an interior surface of the tieback receptacle 56 via a plurality of seals 68. The seals 68 hydraulically seal/isolate junction 28 from the main wellbore 24 during, for example, a drilling operation. The upper portion 60 also may comprise a drilling diverter latch 70 designed to facilitate easy engagement and disengagement of the drilling diverter latch assembly 30 with respect to the upper tieback receptacle 56, as explained in greater detail below.

Figure 4:
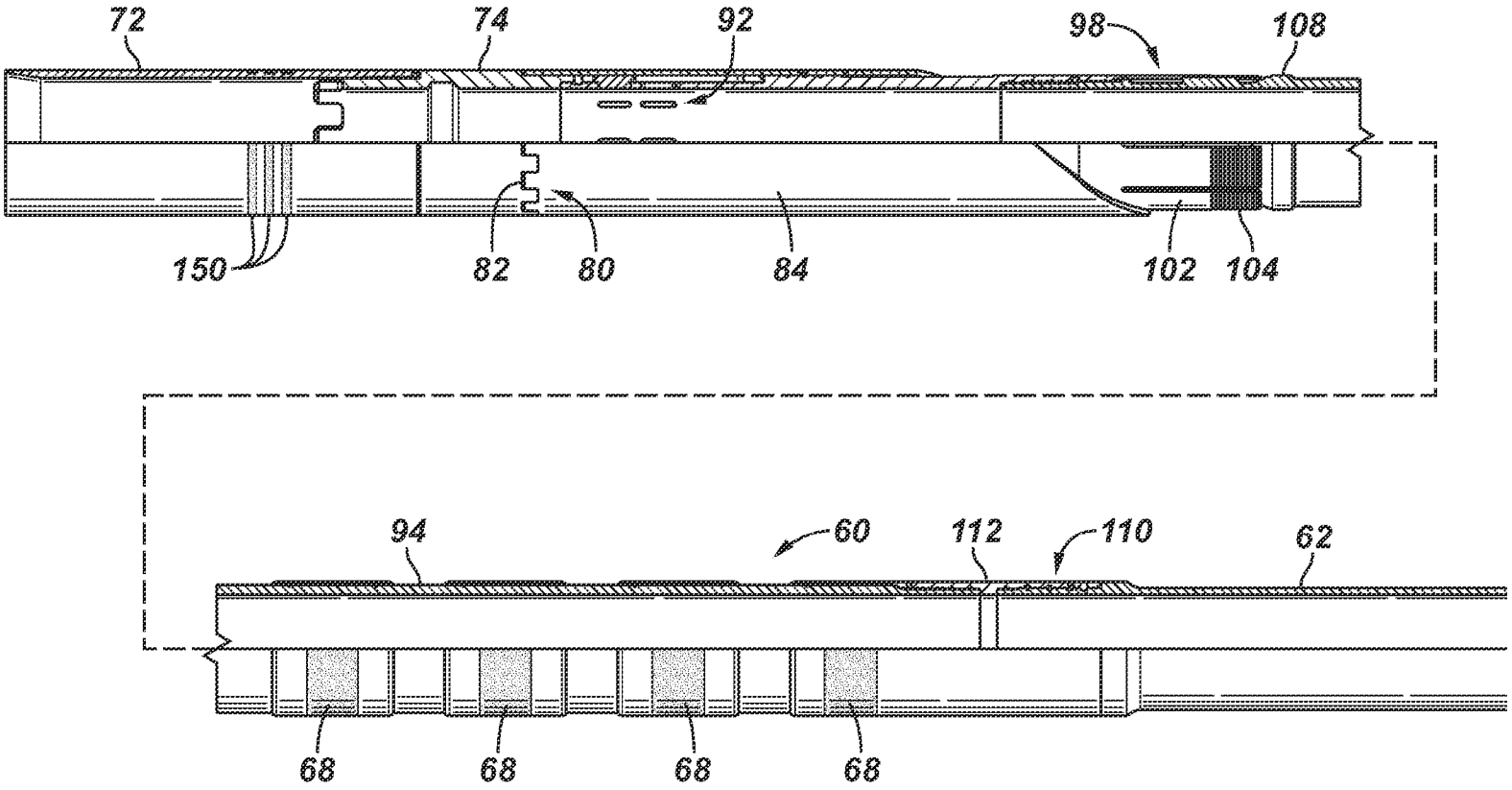
FIG. 4 is a partial cross-sectional illustration of an embodiment of a drilling diverter latch assembly having an upper latch assembly coupled to a lower latch assembly by a swivel, according to an embodiment of the disclosure.
Figure 5:
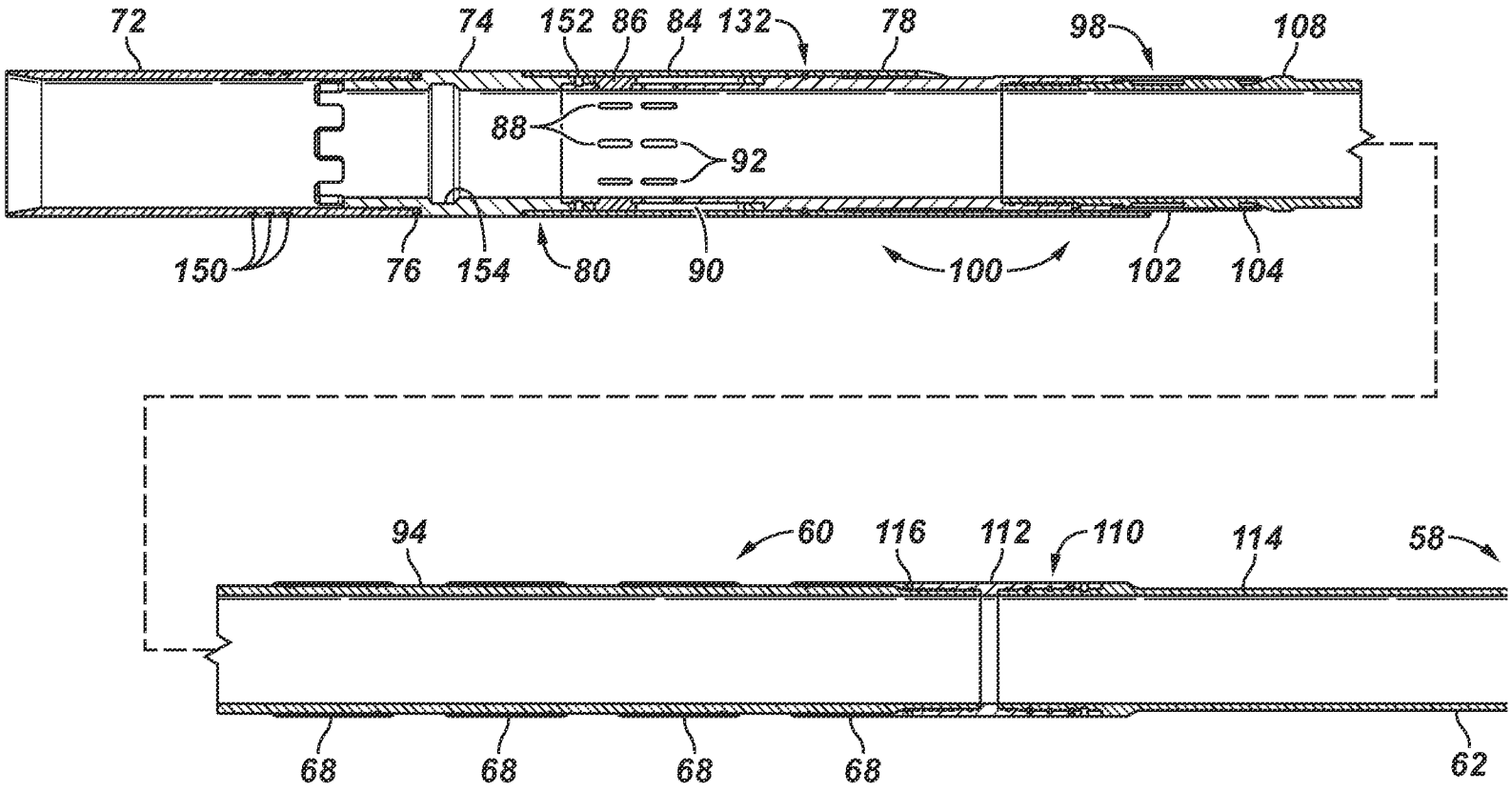
FIG. 5 is a cross-sectional illustration of an embodiment of a drilling diverter latch assembly having an upper latch assembly coupled to a lower latch assembly by a swivel, according to an embodiment of the disclosure.

Referring generally to FIGS. 4 and 5, a more detailed example of upper latch assembly portion 60 is illustrated. However, the specific components selected, the component design, and the arrangement of components may be adjusted according to the parameters of a given application; and the illustrated design is provided as an example to facilitate explanation. In the illustrated embodiment, the upper latch assembly portion 60 comprises a sleeve assembly 72 coupled with a top sub 74. By way of example, the sleeve assembly 72 may be coupled with top sub 74 via a suitable fastener 76, such as at least one setscrew.

The top sub 74 may be coupled with an alignment mule 78, e.g. a mule sleeve, via an engagement feature 80, such as a plurality of castellations 82 (see FIG. 4). The castellations 82 may be in the form of castellated splines. The top sub 74 also is slidably coupled with a torque sub 84 in a manner which allows top sub 74 to rotate torque sub 84 within alignment mule 78 when top sub 74 is moved, e.g. pulled, in an axial direction to disengage the engagement feature 80, e.g. to separate castellations 82. By way of example, top sub 74 may be coupled with torque sub 84 by a plurality of torque members 86 extending between openings 88 formed in torque sub 84 and slots 90 formed in top sub 74. The slots 90 allow axial movement of top sub 74 with respect to torque sub 84 when top sub 74 is pulled in an axial direction to disengage the engagement feature 80. However, the torque members 86 prevent relative rotation of top sub 74 with respect to torque sub 84. In some embodiments, debris features 92, such as slots formed radially through torque sub 84, may be positioned to enable disgorgement of collected debris when the torque members 86 move along slots 90 in top sub 74.

In the example illustrated, the torque sub 84 is coupled to a body 94, e.g. a tubular body/seal mandrel, by a releasable member, such as a collet 98. In the example illustrated, the releasable member, being the collet 98, and the engagement feature 80 cooperate to form a diverter latch 100, e.g. a drilling diverter latch, which can be used to selectively release the diverter latch assembly 30 from the upper tieback receptacle 56 for removal of the diverter latch assembly 30. In the example illustrated, the collet 98 is a threaded collet having a plurality of flexible fingers 102 with threaded regions 104 (see FIG. 4) designed to engage a corresponding threaded region 106 of upper tieback receptacle 56 (see FIG. 3).

Flexible fingers 102 allow the diverter latch assembly 30 to be linearly moved, e.g. stabbed, into engagement with threaded region 106 of upper tieback receptacle 56. However, release of collet 98 from the upper tieback receptacle 56 involves rotation of torque sub 84 and collet 98 to unthread threaded regions 104 from corresponding threaded region 106. Thus, release of diverter latch assembly 30 involves axial movement of top sub 74 to release top sub 74 from alignment mule 78 via disengagement of castellations 82 followed by rotation of top sub 74, torque sub 84, and collet 98 to release collet 98 from the upper tieback receptacle 56. In some applications, the threaded regions 104 are designed so that the collet 98 is rotated several times prior to release, e.g. 10-30 rotations or in some applications 20-25 rotations. A cone feature 108 may be positioned on body 94 proximate collet fingers 102 such that an axial, tensile force applied to diverter latch assembly 30 prior to release of collet 98 effectively forces the flexible fingers 102 in a radially outward direction and into more secure engagement with the surrounding threaded region 106 of upper tieback receptacle 56.

The upper portion 60 of diverter latch assembly 30 may be coupled to the lower portion 58 of diverter latch assembly 30 across a swivel 110. Rotation of collet 98 is facilitated by swivel 110, which effectively allows the upper portion 60 to rotate relative to the lower portion 58 of diverter latch assembly 30. In the example illustrated, swivel 110 comprises a swivel housing 112 connected between body 94 and a crossover tubing 114. The crossover tubing 114, in turn, is connected to tubing 62 of the lower portion 58 of diverter latch assembly 30. The swivel housing 112 may be connected to body 94 by a suitable fastener 116, such as at least one setscrew. Accordingly, swivel 110 allows the joined top sub 74, torque sub 84, and body 94 to rotate relative to crossover tubing 112 and the lower portion 58 of diverter latch assembly 30.

Figure 6:
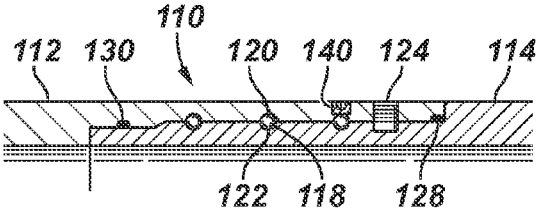
FIG. 6 is a cross-sectional view of a portion of the assembly illustrated in FIG. 5, according to an embodiment of the disclosure.

By way of example, swivel 110 may comprise a ball bearing style swivel. With added reference to FIG. 6, an embodiment of swivel 110 comprises a plurality of balls 118, e.g. steel balls, mounted in corresponding slots 120, 122 formed in rotatably engaged portions of swivel housing 112 and crossover tubing 114. The balls 118 facilitate relative rotation between body 94 and crossover tubing 114. In some embodiments, a shear member 124, such as a shear screw, may initially be disposed between swivel housing 112 and crossover tubing 114 to restrict relative rotation until a torque threshold is met. The swivel 110 also may comprise other components, such as a lubrication plug 140 and a debris feature to limit the entry of debris into the ball bearing area carrying balls 118. By way of example, the debris feature may comprise a debris ring 128 and a seal 130, e.g. an O-ring seal, located on opposite sides of balls 118, as illustrated.

Figure 7:
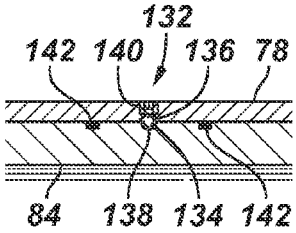
FIG. 7 is a cross-sectional view of another portion of the assembly illustrated in FIG. 5, according to an embodiment of the disclosure.

The upper portion 60 of diverter latch assembly 30 also may comprise a variety of other or additional features. For example, a bearing 132 may be positioned between the torque sub 84 and the surrounding alignment mule 78, as further illustrated in FIG. 7. By way of example, the bearing 132 may comprise a ball bearing having a ball or balls 134 captured in cooperating slots 136 and 138 of alignment mule 78 and torque sub 84, respectively. A lubrication plug 140 also may be used to provide a pathway for lubrication to be injected to the bearing 132. In the example illustrated, the bearing 132 further comprises a debris feature in the form of debris rings 142 disposed on opposite sides of ball 134.

Figure 8:
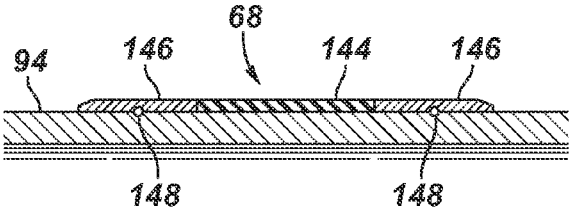
FIG. 8 is a cross-sectional view of another portion of the assembly illustrated in FIG. 5, according to an embodiment of the disclosure.
Figure 9:
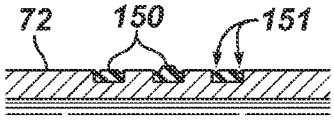
FIG. 9 is a cross-sectional view of another portion of the assembly illustrated in FIG. 5, according to an embodiment of the disclosure.

Additionally, a plurality of the seals 68 may be positioned along body 94 to provide sealing engagement with the interior surface of upper tieback receptacle 56. Although a variety of seals 68 may be employed, an example is illustrated in FIG. 8 in which a V-package seal 144 is positioned between lock rings 146 held in place by lock wires 148. Additionally, a plurality of seals 150 may be positioned around sleeve assembly 72 for sealing engagement with an interior surface of tieback receptacle 56. The seals 150 may be designed to provide an additional debris feature which limits movement of debris down into the region of diverter latch 100 within upper tieback receptacle 56. By way of example, seals 150 may comprise a set of three molded rubber rings having offset flow slots 151 to aid in running the diverter latch assembly 30 downhole while providing debris protection similar to, for example, a labyrinth type seal.

In some applications, a shear member 152, such as a shear screw, also may be positioned between top sub 74 and alignment mule 78 to avoid inadvertent disengagement of engagement feature 80. For example, the shear member 152 can be used to block separation of castellations 82 until an axial pulling force above a predetermined threshold is applied to the top sub 74. Additionally, top sub 74 or another suitable component, may comprise a running tool engagement feature 154, such as the internal annular recess illustrated in FIG. 5. Depending on the specific application and environment in which the diverter latch assembly 30, e.g. drilling diverter latch assembly, is employed, a variety of other features or combinations of features may be incorporated to facilitate a given operation.

Figure 11:
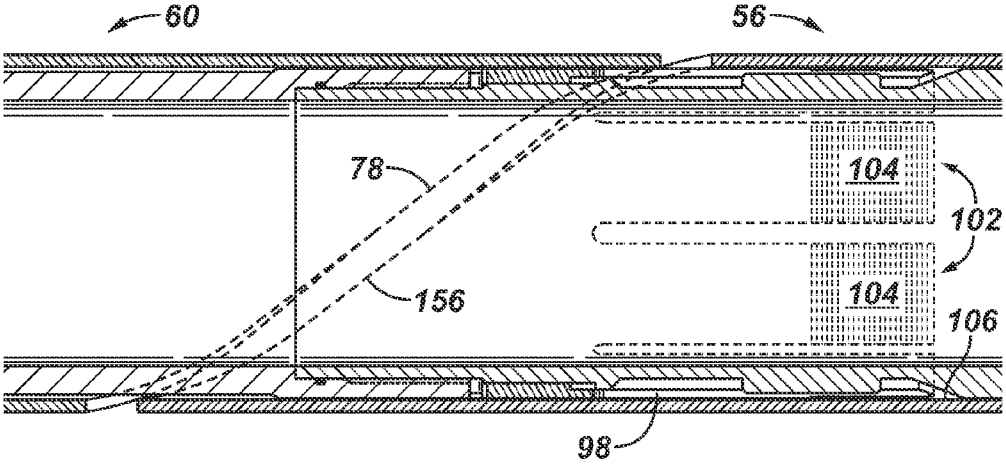
FIG. 11 is an illustration of an embodiment of a drilling diverter latch used in cooperation with the mating alignment mules illustrated in FIG. 10, according to an embodiment of the disclosure.
Figure 10:
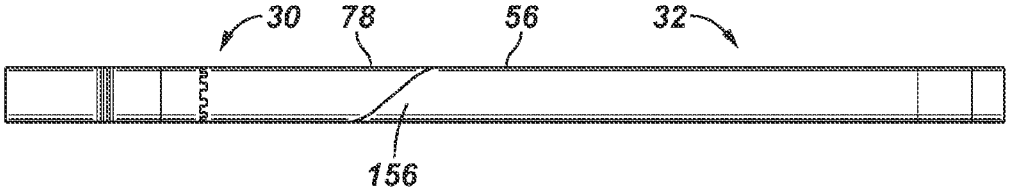
FIG. 10 is an illustration of an embodiment of the drilling diverter latch assembly engaged with a surrounding well completion via mating alignment mules, according to an embodiment of the disclosure.

Referring generally to FIGS. 10-11, an embodiment is illustrated in which drilling diverter latch assembly 30 has been engaged with the downhole well equipment 32. In this example, movement of the drilling diverter latch assembly 30 downhole causes alignment mule 78 to align with a matching profile of a corresponding alignment mule 156 positioned on the upper tieback receptacle 56, e.g. a packer tieback receptacle, located in main wellbore 24. Once the alignment mule 78 and the corresponding alignment mule 156 are aligned, the geometry of the mules prevents rotation between the drilling diverter latch assembly 30 and the tieback receptacle 56. The collet 98 of diverter latch 100 locks into the matching threaded profile 106 along the interior of upper tieback receptacle 56. However, the diverter latch 100 enables selective disengagement by axially shifting top sub 74 and rotating collet 98 to unthread the collet 98 from threaded region 106 of the upper tieback receptacle 56. The locking cone 108 transfers any hydraulic axial loading acting on the diverter latch assembly into the collet 98 of latch 100 and thus into the corresponding threads 106 of tieback receptacle 56 to prevent inadvertent release, as described above.

In an operational example, drilling diverter latch assembly 30 is run in hole led by stinger 64 and a relatively long section of tubing 62, e.g. drilling diverter casing, that may extend 60-90 feet (18-28 m) in length. Jointed pipe and a liner hanger style running tool may be used to convey the drilling diverter latch assembly into the well 22. Once the latch 100 of the drilling diverter latch assembly 30 reaches the upper, lateral packer tieback receptacle 56, the latch 100 engages the mating threaded profile 106 to lock the drilling diverter latch assembly 30 in place.

The mated mule shoe shaped surfaces of alignment mule 78 and corresponding alignment mule 156 properly align the assembly 30 and prevent unwanted rotation of the drilling diverter latch assembly 30. The cone feature 108 on the body 94 ensures that any upward force created by the drilling pressure transfers into the diverter latch 100, e.g. collet 98, and prevents premature release. Additionally, the seals 68 on the body 94 provide a hydraulic seal within the tieback receptacle 56. In this example, lower hydraulic isolation is provided by seals 66 on stinger 64 which seal against a lower tieback receptacle 36 which may be in the form of a lateral liner.

At this stage, a drilling operation may be performed and drilling of the lateral lining can occur once the running tool string is removed and the drill string is run in hole. The drilling diverter latch assembly 30 is not removable without an upward stroke of the top sub 74 and a subsequent rotation of collet 98 to disengage the threaded regions 104 from the corresponding threads 106 of the tieback receptacle 56. Downward forces on the drilling diverter latch assembly are transferred into the latch 100 and subsequently into the upper tieback receptacle 56. However, once removal of the drilling diverter latch assembly 30 is desired, the running tool string is again run to depth and latched into the top sub 74 via running tool engagement feature 154. Tension is then applied the top sub 74 in an axial, uphole direction to create a space between the top sub 74 and the alignment mule 78. This axial shifting disengages the castellated splines 82 and allows the latch 100, and specifically collet 98, to be rotated via the running tool without rotating the alignment mule 78.

The bearing feature 132 located within the alignment mule 78 facilitates free rotation of the top sub 74, torque sub 84, and body 94 without rotating the alignment mule 78. The system may be designed to accommodate rotation in either direction. In an example, however, the threaded regions 104 engaged with corresponding threads 106 of tieback receptacle 56 have a left-hand thread feature such that a right-hand rotation begins to disengage the drilling diverter latch assembly 30 from the upper tieback receptacle 56. After a predetermined number of turns, e.g. 20-25 turns, the drilling diverter latch assembly 30 is freed without rotating the lower portion 58 of the drilling diverter latch assembly 30. Once free, the drilling diverter latch assembly 30 can be pulled out of hole.

Shear members 124 may be used in swivel 110 so the torque applied to release drilling diverter latch assembly 30 is greater than a predetermined amount of resistance provided by the shear members 124. Once the shear members 124 are sheared, the collet 98 may be freely rotated (without rotating the relatively long section of drilling diverter casing 62) until the drilling diverter latch assembly 30 is released. The shear members 124, e.g. shear pins, protect against inadvertent release of the latch 100 due to various smaller level torques that may be applied during running in hole and/or during engagement of the drilling diverter latch assembly 30 with the downhole equipment 32. It should be noted the various debris barrier features described above are designed to prevent the accumulation of large amounts of debris proximate the diverter latch 100 which could inhibit retrieval of the drilling diverter latch assembly 30.

Depending on the parameters of a given application, the diverter latch assembly 30 may be used to facilitate movement of various tubing strings from main wellbore 24 into lateral wellbore 26. In drilling applications, the design of the diverter latch assembly 30 facilitates movement of drill strings and drill bits having relatively large diameters into the lateral wellbore. During the drilling or other operation in lateral wellbore 26, the lower seals 66 and the upper seals 68, 150 provide hydraulic isolation with respect to junction 28. However, various types of seals and sealing systems may be employed along the diverter latch assembly 30 to provide a desired hydraulic isolation.

Additionally, the diverter latch assembly 30 may be designed in various configurations with selected lengths suitable to span junction 28. The diverter latch assembly 30 also may comprise various other and/or additional components designed to facilitate aspects of a given operation in the lateral wellbore. Similarly, the diverter latch 100 may comprise many types of components designed to facilitate selective engagement as well as disengagement via the sequential longitudinal and rotational movements that control disengagement and separation of the diverter latch assembly from the downhole equipment.

By way of further example, the overall system may utilize many types of downhole well equipment 32. The downhole well equipment 32 may comprise a variety of completion components in both the main wellbore and the lateral wellbore to facilitate desired production operations or other types of operations. The equipment also may comprise various components and arrangements of components to address parameters of a given environment and/or well structure.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system to facilitate drilling of a lateral wellbore, comprising:

a drilling diverter latch assembly having a lower latch assembly comprising a tubing with a lower seal positioned to form a seal below a junction with a lateral wellbore and an upper latch assembly with an upper seal positioned to form a seal with an upper tieback receptacle located above the junction with the lateral wellbore, the upper latch assembly comprising:

a swivel located to allow the upper latch assembly to be rotated relative to the tubing in the lower latch assembly;

a drilling diverter latch selectively securing the drilling diverter latch assembly via engagement with the upper tieback receptacle, the drilling diverter latch being releasable from the upper tieback receptacle by shifting a portion of the drilling diverter latch in an axial direction followed by rotational movement of the portion, the drilling diverter latch comprising a threaded collet engaged with an interior of the upper tieback receptacle, the portion of the drilling diverter latch comprising an upper sub slidably engaged with a first alignment mule via a plurality of castellations, the first alignment mule positioned to engage a second, corresponding alignment mule mounted proximate the upper tieback receptacle, wherein the shifting in an axial direction comprises pulling on the upper sub to move the castellations out of engagement and wherein the rotational movement comprises rotating the threaded collet to unthread the threaded collet from the upper tieback receptacle after disengagement of the castellations; and a torque member engaging a slot in a manner which allows axial movement of the upper sub relative to the threaded collet while restricting rotational movement of the upper sub relative to the threaded collet.

2. The system as recited in claim 1, wherein the swivel allows the threaded collet to rotate relative to the tubing of the lower latch assembly.

3. The system as recited in claim 1, wherein the drilling diverter latch assembly further comprises a plurality of debris features wherein the debris features comprise one or more rings.

4. The system as recited in claim 1, wherein the upper sub comprises a running tool engagement feature.

5. The system as recited in claim 1, wherein the drilling diverter latch assembly comprises a plurality of set screws positioned to initially resist the shift in an axial direction and the rotational movement.

6. The system as recited in claim 1, wherein the threaded collet comprises flexible fingers that flex upon insertion into a corresponding threaded region of the upper tieback receptacle to enable the threaded collet to be stabbed into secure engagement with the upper tieback receptacle.

7. The system as recited in claim 6, wherein the flexible fingers are engaged by a cone member positioned to force the flexible fingers outwardly toward the corresponding threaded region of the upper tieback receptacle when tension is placed on the upper latch assembly prior to applying the rotational movement to disengage the threaded collet from the upper tieback receptacle.

8. The system as recited in claim 1, wherein the upper latch assembly comprises a bearing mounted along an interior of the first alignment mule.

9. A system, comprising:

a diverter latch assembly having an upper latch assembly coupled with a lower latch assembly via a swivel, the upper latch assembly further comprising a releasable latch positioned to engage a tieback receptacle located in a well having a lateral wellbore, the swivel enabling rotation of the releasable latch without rotation of the lower latch assembly during release of the diverter latch assembly from the tieback receptacle wherein the releasable latch comprises a collet, positioned to securely engage the tieback receptacle, and an upper sub shiftable in an axial direction relative to the collet, the upper sub being engaged with an alignment mule via an engagement feature.

10. The system as recited in claim 9, further comprising at least one debris feature positioned to remove accumulated debris during axial shifting of the upper sub wherein the at least one debris feature comprises a ring.

11. The system of claim 3 further comprising a plurality of the said one or more rings wherein at least some of the rings comprise offset flow slots.

12. The system of claim 11 wherein the offset flow slots form a labyrinth type seal.

13. A system to facilitate drilling of a lateral wellbore, comprising:

a drilling diverter latch assembly comprising an upper latch assembly, a lower latch assembly coupled to the upper latch assembly, and a torque member, the lower latch assembly comprising a tubing with a lower seal positioned to form a seal below a junction with a lateral wellbore and the upper latch assembly having an upper seal positioned to form a seal with an upper tieback receptacle located above the junction with the lateral wellbore, the upper latch assembly comprising:

a swivel located to allow the upper latch assembly to be rotated relative to the tubing in the lower latch assembly;

a first alignment mule positioned to engage a second, corresponding alignment mule mounted proximate the upper tieback receptacle; and a drilling diverter latch selectively securing the drilling diverter latch assembly via engagement with the upper tieback receptacle, the drilling diverter latch being releasable from the upper tieback receptacle by shifting a portion of the drilling diverter latch in an axial direction followed by rotational movement of the portion, wherein the drilling diverter latch comprises a threaded collet engaged with an interior of the upper tieback receptacle, and an upper sub shiftable in an axial direction relative to the threaded collet, wherein the upper sub slidably engages with the first alignment mule via a plurality of castellations, the shifting in an axial direction comprises pulling on the upper sub to move the castellations out of engagement, the rotational movement comprises rotating the threaded collet to unthread the threaded collet from the upper tieback receptacle after disengagement of the castellations, and the torque member engages a slot in a manner which allows axial movement of the upper sub relative to the threaded collet while restricting rotational movement of the upper sub relative to the threaded collet.

14. The system as recited in claim 13, wherein the swivel allows the threaded collet to rotate relative to the tubing of the lower latch assembly.

15. The system as recited in claim 13, wherein the drilling diverter latch assembly further comprises a plurality of debris features wherein the debris features comprise one or more rings.

16. The system as recited in claim 13, wherein the upper sub comprises a running tool engagement feature.

17. The system as recited in claim 13, wherein the drilling diverter latch assembly comprises a plurality of set screws positioned to initially resist the shift in an axial direction and the rotational movement.

18. The system as recited in claim 13, wherein the threaded collet comprises flexible fingers that flex upon insertion into a corresponding threaded region of the upper tieback receptacle to enable the threaded collet to be stabbed into secure engagement with the upper tieback receptacle.

19. The system as recited in claim 18, wherein the flexible fingers are engaged by a cone member positioned to force the flexible fingers outwardly toward the corresponding threaded region of the upper tieback receptacle when tension is placed on the upper latch assembly prior to applying the rotational movement to disengage the threaded collet from the upper tieback receptacle.

20. The system as recited in claim 13, wherein the upper latch assembly comprises a bearing mounted along an interior of the first alignment mule.

21. The system of claim 15 further comprising a plurality of the said one or more rings wherein at least some of the rings comprise offset flow slots.

22. The system of claim 21 wherein the offset flow slots form a labyrinth type seal.

* * * * *